US009006963B1

(12) United States Patent
Al-Saqabi

(10) Patent No.: US 9,006,963 B1
(45) Date of Patent: Apr. 14, 2015

(54) LIGHT BULB WITH DUAL CONNECTORS

(71) Applicant: Daoud S A N Al-Saqabi, Khitan (KW)

(72) Inventor: Daoud S A N Al-Saqabi, Khitan (KW)

( * ) Notice: Subject to any disclaimer, the term of this patent is extended or adjusted under 35 U.S.C. 154(b) by 0 days.

(21) Appl. No.: 14/530,839

(22) Filed: Nov. 3, 2014

(51) Int. Cl.

| | |
|---|---|
| ***H01J 5/50*** | (2006.01) |
| ***H01R 13/40*** | (2006.01) |
| ***F21K 99/00*** | (2010.01) |
| ***F21V 23/06*** | (2006.01) |
| ***H01R 31/06*** | (2006.01) |

(52) U.S. Cl.
CPC ..... *F21K 9/1355* (2013.01); *F21V 23/06* (2013.01); *H01R 31/065* (2013.01)

(58) Field of Classification Search
USPC ..... 313/318.01–318.07
See application file for complete search history.

(56) References Cited

U.S. PATENT DOCUMENTS

| | | | | |
|---|---|---|---|---|
| 4,816,977 | A * | 3/1989 | Sorensen | 362/448 |
| 4,928,032 | A * | 5/1990 | Skoch et al. | 313/318.04 |
| 5,989,070 | A | 11/1999 | Al-Turki | |
| 7,794,282 | B1 * | 9/2010 | Barger | 439/646 |
| 8,350,452 | B1 | 1/2013 | Sundhar | |

* cited by examiner

*Primary Examiner* — Sikha Roy

(57) ABSTRACT

A light bulb with dual connector comprising a connector assembly for lamps/bulbs rotatably connected to the lamp body to provide alternative connective means for engaging different types of lamp sockets. The connector is integrally assembled with respect to the lamp such that the electrical connection necessary to illuminate the lamp is operative at all times. The connector is defined by an elongated body having a spiral/screw-threaded connector (spiral installation head) at one end and a pin-type (pressed installation head) at its opposite. Dependent upon the type of socket/holder available (screw threaded or pin type), the head most suited for a particular holder can be rotated to an operative position to facilitate installation of the inventive lamp-connector combination into the socket/holder.

10 Claims, 5 Drawing Sheets

LIGHT BULB WITH DUAL CONNECTORS

BACKGROUND OF THE INVENTION

1. Field of the Invention

The present invention relates generally to connection systems for light bulbs. More specifically, the invention is a connector assembly for lamps/bulbs rotatably connected to the lamp body to provide alternative connective means for engaging different types of lamp sockets.

2. Description of the Related Art

An ordinary light bulb or ordinary energy-saving light bulbs, only the size and intensity of the light emitted a light for illumination, can't be used when adjusting the lamp power, when people in the leisure, entertainment or as a walkway lighting Occasion, it can't meet people needs and energy. Numerous light bulb socket adapters have been provided in the prior art.

Of particular interest is the U.S. Pat. No. 5,989,070, issued to Al-Turki, which discloses several embodiments of a light bulb connection system that facilitates the connection of a light bulb in a socket using either an Edison-type (screw-type) or a pin-type connective configuration. In practice, the system includes an adapter that permits any bulb to be used in any type of socket, and in use, both screw connections and bayonet connections are possible.

Furthermore, the U.S. Pat. No. 8,350,452 B1, issued to Sundhar, shows a light bulb assembly and system where a bulb 70 having a non-threaded connective base or bottom-side 72, with the use of a socket connection assembly 30, can be connected to a screw-threaded lamp/bulb socket 15.

Accordingly, there is a need for an improved light bulb with dual connectors to provide alternative connective means for engaging different types of lamp sockets.

SUMMARY OF THE INVENTION

The present invention relates A light bulb with dual connector comprising a connector assembly for lamps/bulbs rotatably connected to the lamp body to provide alternative connective means for engaging different types of lamp sockets. The connector is integrally assembled with respect to the lamp such that the electrical connection necessary to illuminate the lamp is operative at all times. The connector is defined by an elongated body having a spiral/screw-threaded connector (spiral installation head) at one end and a pin-type (pressed installation head) at its opposite. Dependent upon the type of socket/holder available (screw threaded or pin type), the head most suited for a particular holder can be rotated to an operative position to facilitate installation of the inventive lamp-connector combination into the socket/holder.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
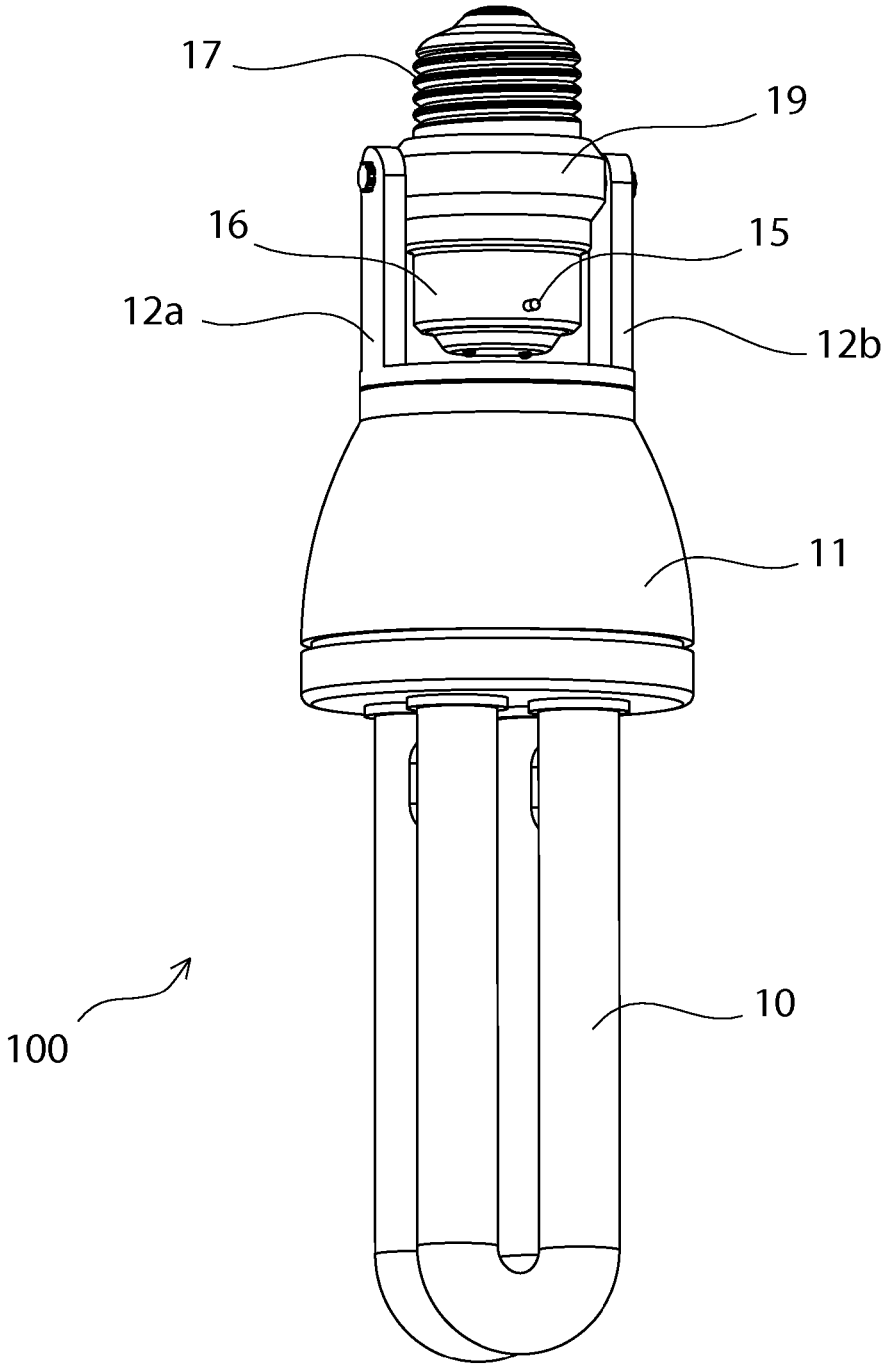
FIG. 1 is an environmental, perspective view of a light bulb with dual connector.

The present invention relates a light bulb 100 with dual connector assembly comprising a connector assembly 1 for lamps/bulbs 100 rotatably connected to the lamp body 2 to provide alternative connective means for engaging different types of lamp sockets. The dual connector 1 is integrally assembled with respect to the lamp such that the electrical connection necessary to illuminate the lamp is operative at all times. The dual connector is suitable for any kind of bulbs as saving bulbs or LED bulbs.

Figure 2:
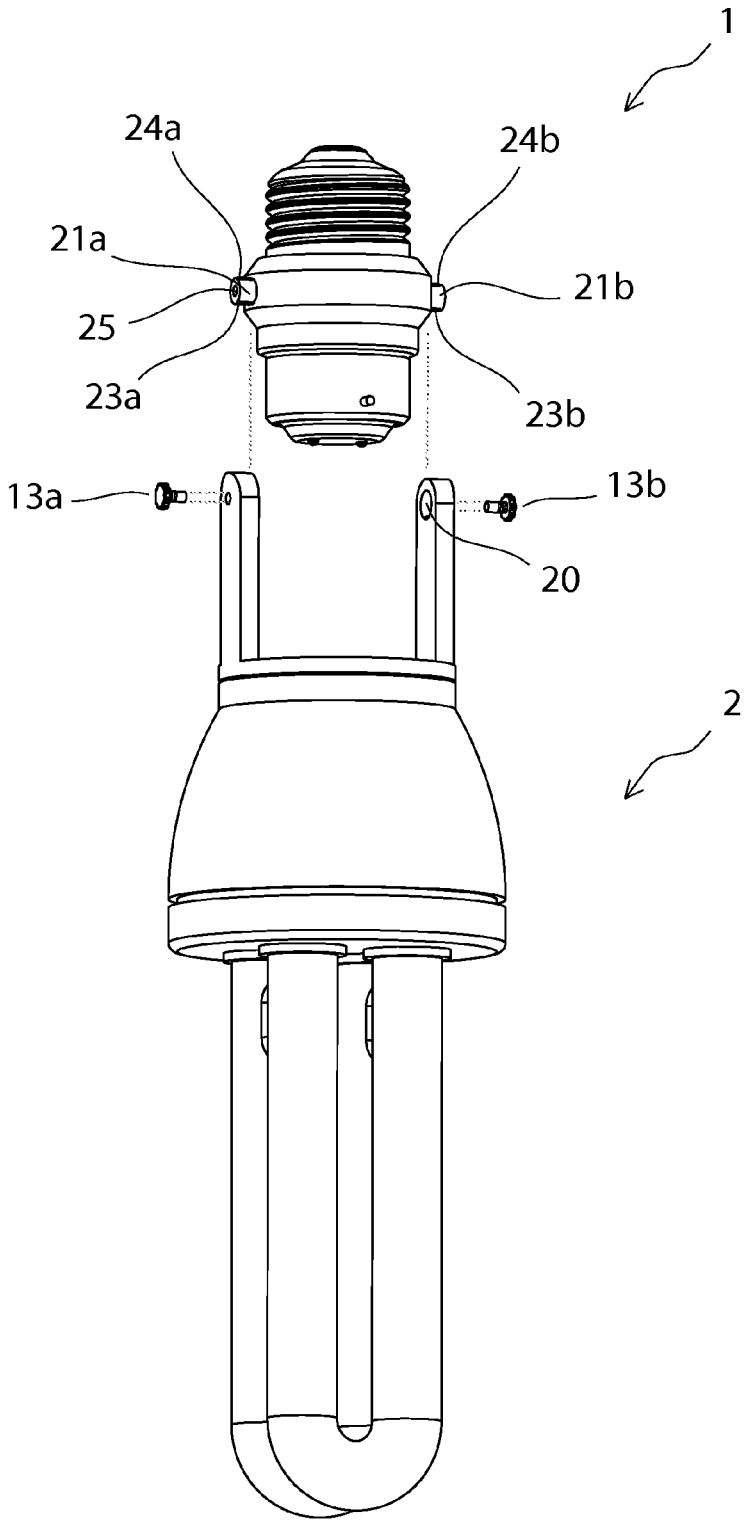
FIG. 2 is a perspective view of parts assembly of light bulb with dual connector.
Figures 3A, 3B:
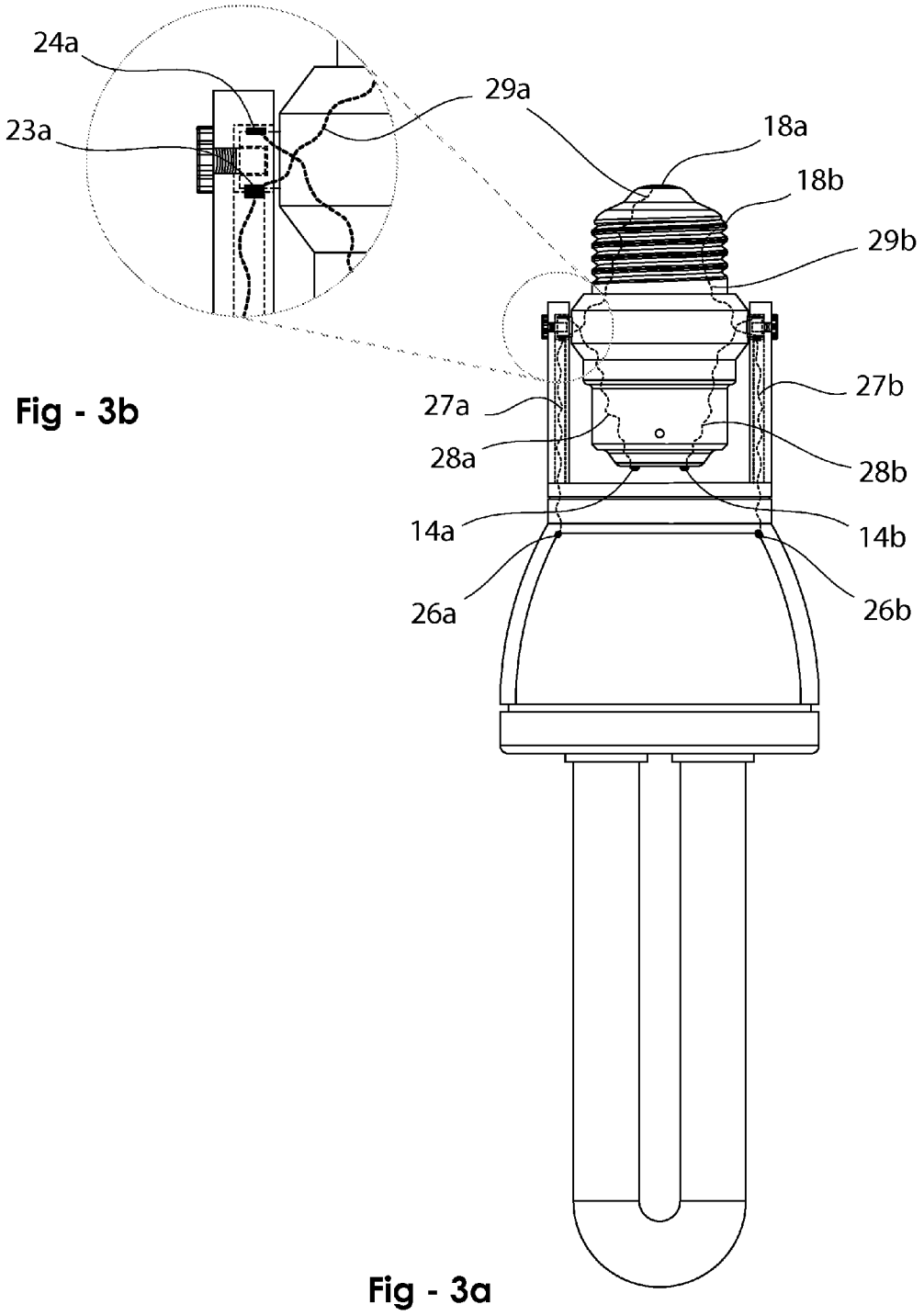
FIG. 3*a* is a perspective view of electric connection of the dual connector of the light bulb.
FIG. 3*b* is a cross-section describing electric connection between the dual connector and the light bulb body.
Figures 4A, 4B:
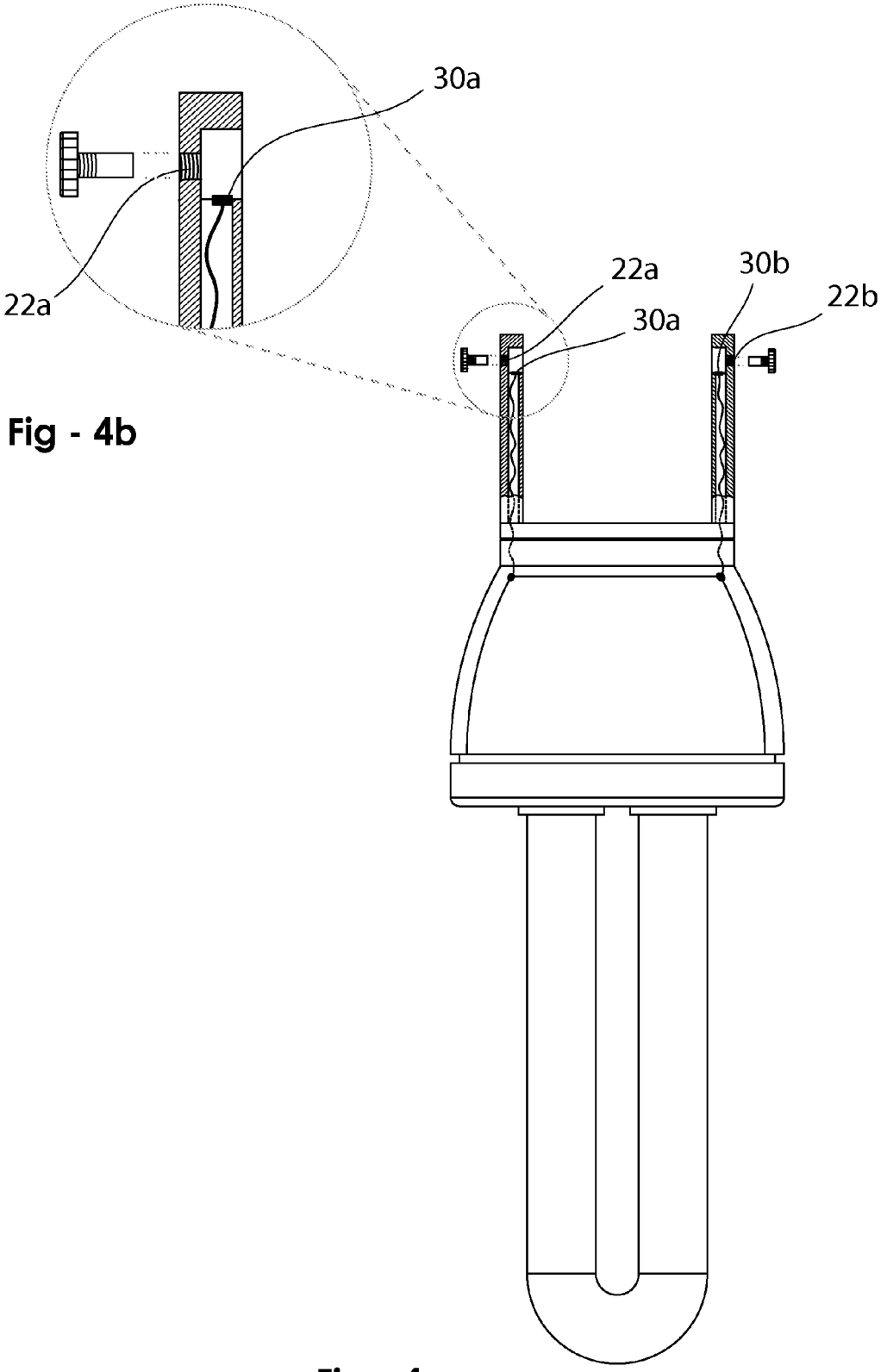
FIG. 4*a* is a perspective view of light bulb body with its holder.
FIG. 4*b* is a cross-section of holder assembly of the light bulb.
Figure 5:
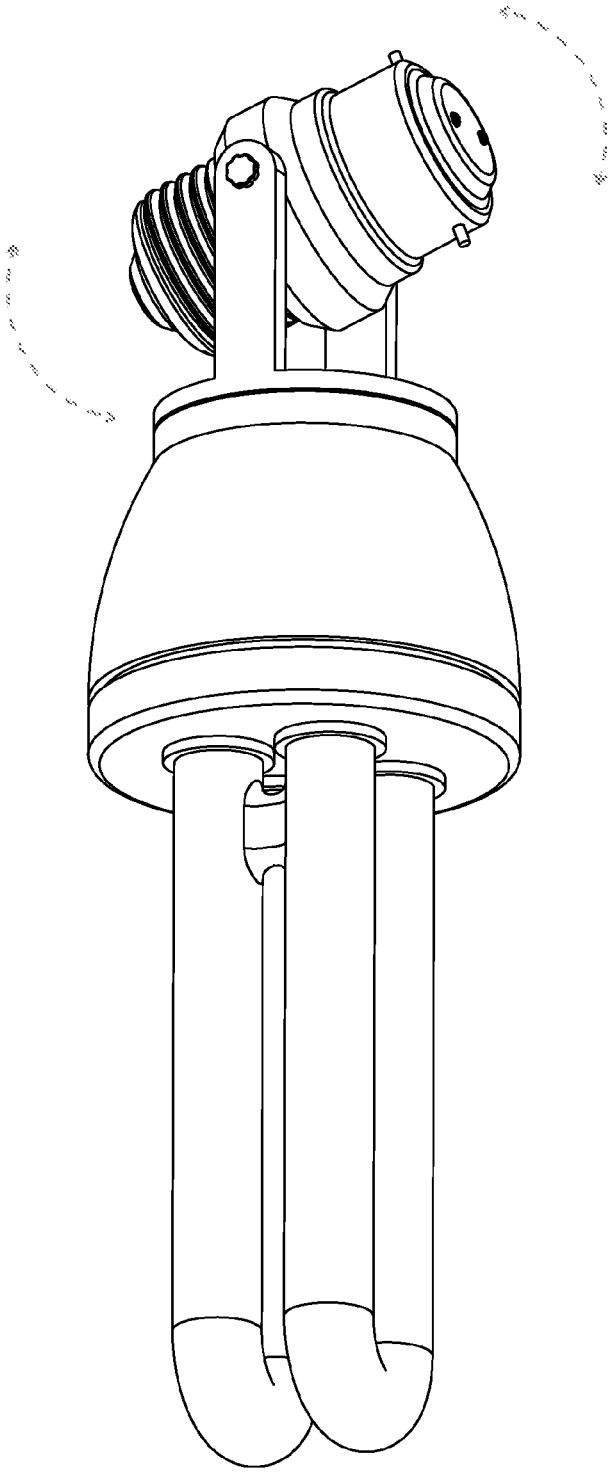
FIG. 5 is a perspective view of the connector assembly for lamps/bulbs rotatably connected to the lamp body.

Referring to all FIGS. 1 to 5, the dual connector assembly 1 is defined by a nonconductive barrier layer 19 attached to screw-threaded cap 17 (spiral installation head) at one end and a pin-type cap 16 (pressed installation head) at its opposite. The screw cap 17 has a pair of upper side conductive terminals 18*a* and 18*b*. Also the pin-type cap 16 has two pins 15 for fastening the pin-type cap 16 into the socket and the pin-type cap 16 has a pair of contact terminals 14*a* and 14*b* from the underside. The dual connector 1 has a pair of rotary pins 21*a* and 21*b* housed in the left and right side of the nonconductive barrier layer 19 respectively. The dual connector 1 attached to the bulb body 2 through the pair of rotary pins 21*a* and 21*b*. The pair of rotary pin 21*a* and 21*b* is attached to the nonconductive layer 19 from one side and has a rotary pin hole 25 in the opposite side. The left rotary pin 21*a* has an underside and upper side contact terminals 23*a* and 24*a* respectively and the underside rotary pin contact terminal 23*a* is connected to the left contact terminal 18*a* of the screw-threaded cap 17 by conductive wire 29*a* where the upper side rotary pin contact terminal 24*a* is connected to the left contact terminal of pin-type cap 14*a* by conductive wire 28*a*. Simultaneously, the right rotary pin 21*b* has an underside and upper side contact terminals 23*b* and 24*b* respectively and the underside contact terminal 23*b* of the right rotary pin 21*b* is connected to the right contact terminal 18*b* of the screw-threaded cap 17 by conductive wire 29*b* where the upper side contact terminal 24*b* is connected to the left contact terminal of pin cap 14*b* by conductive wire 28*b*. These conductive wires 29*a*, 29*b*, 28*a*, and 28*b* enable the two caps 17 and 16 ready for electricity connection. This means that the two terminals of the cap even it is screw or pin type are connected and touched to the furthest contact terminals of the rotary pins 21*a* and 21*b* not to the closest one which operative electric connection between the cap and the bulb body and so the operation of the light bulb. Dependent upon the type of socket/holder available (screw threaded or pin type), the head most suited for a particular holder can be rotated (FIG. 5) to an operative position to facilitate installation of the inventive lamp-connector combination into the socket/holder.

The bulb body 2 has a glass bulb 10 attached to ballast housing 11 which attached to a pair of sides elongated bulb holder 12*a*, and 12*b*. The glass bulb 10 can be for saving energy bulbs or is an LED strip (not shown in figures) for LED bulbs. The pair of bulb holders 12*a* and 12*b* is attached to the ballast housing 11 from one end and to the dual connector assembly 1 from the opposite end by the pair of rotary pins 21*a*, and 21*b*. The dual connector assembly 1 rotates around the pair of rotary pins 21*a*, and 21*b* to an operative position to facilitate of the lamp into any socket holder types.

The pair of bulb holders 12*a* and 12*b* has holding holes 20 in the inner side of the bulb holders 12*a* and 12*b*. These two holding holes 20 are used to hold and fasten the dual connector 1 by inserting the pair of rotary pins 21*a* and 21*b* into holding holes 20 in both left bulb holder 12*a* and into right bulb holder 12*b* respectively. The pair of bulb holders 12*a* and 12*b* has also screw fasten holes 22*a* and 22*b* respectively from the outer side to inserting a pair of bolts 13*a* and 13*b* for fastening the dual connector 1 tightly.

The two holding holes 20 have a pair of contact terminal means 30*a* and 30*b* attached to the underside surface of the right and left hole 20. The first hole contact terminal 30*a* is connected to a left ballast contact terminal 26*a* by first conductive wire 27*a* and the second hole contact terminal 30*b* is connected to a right ballast contact terminal 26*b* by second conductive wire 27*b*. The left and right ballast contact terminals 26*a* and 26*b* are housed in the left and right upper side of the ballast housing 11 respectively wherein the first and second conductive wires 27*a* and 27*b* are extending through inside the left bulb holder 12*a* and the right bulb holder 12*b* respectively.

The operation of the light bulb 100 is described with reference to figures. The operation, inserting the pair of rotary pins 21*a* and 21*b* into holding holes 20 in both left bulb holder 12*a* and into right bulb holder 12*b* respectively, inserting the pair of bolts 13*a* and 13*b* into the screw fasten holes 22*a* and 22*b* respectively to tightly fasten and lock the pair of rotary pins 21*a* and 21*b* and enable the dual connector to rotate easily. The first bolt 13*a* is inserted into the left screw fasten hole 22*a* and the second bolt 13*b* is inserted into the right screw fasten hole 22*b*. The pair of bolts 13*a* and 13*b* has a bolt head, thread part attached to the head and unthreaded part in the end. When tightening the pair of screw bolt 13*a* and 13*b*, the thread part is housed in the screw fasten holes 22*a* and 22*b* and the unthreaded part of the bolt housed in a pair of rotary pin holes 25 for fastening the pair of rotary pin 21*a* and 21*b*. After fastening the dual connector 1 the pair of hole contact terminals 30*a* and 30*b* touches and contacts to the pair of contact terminal of the dual connector caps 17 or 16 according to the needed cap, so the electric connection between the bulb body 2 and dual connector 1 is operative and so the light bulb is illuminated after inserting the bulb in the socket/holder.

It is to be understood that the present invention is not limited to the embodiments described above, but encompasses any and all embodiments within the scope of the following claims.

The invention claimed is:

1. A light bulb with dual connector assembly comprising:

a bulb body having a ballast housing attached to a glass bulb from one end and to a pair of sides elongated bulb holders from the opposite end, wherein said pair of bulb holders having left and right bulb holder attached to left and right sides of the ballast housing from one end and having a pair of holding holes in the inner side of said pair of bulb holders with a pair of screw fasten holes in the outer side of said pair of bulb holder from the other end of said pair of bulb holder, wherein said pair of holding holes having a pair of electric contact terminals attached to the underside surface of the right and left holding hole;

a first pair of conductive wire connecting said pair of electric contact terminal housed in said pair of holding holes to a pair of electric contact terminal housed in said ballast housing, wherein said first pair of conductive wire extending through inside said left and right bulb holder;

a dual connector assembly rotatably connected to said pair of bulb holder providing alternative connective means for engaging different types of lamp sockets, wherein said dual connector having a nonconductive barrier layer attached to a screw-threaded cap at one end and a pin-type cap at an opposite end, wherein said screw-threaded cap having a pair of an upper side contact terminals, wherein said pin-type cap having two pins for fastening said pin-type cap into the lamp socket and a pair of contact terminals from the underside;

a pair of rotary pins attached in the left and right side of said nonconductive barrier layer, wherein said pair of rotary pins attached to said nonconductive layer from one side and having a rotary pin hole in the opposite side, wherein said pair of rotary pins having an underside and upper side contact terminals;

a second pair of conductive wire connecting said pair of an upper side contact terminals of said screw-thread cap to said underside rotary pin contact terminals;

a third pair of conductive wire connecting said pair of contact terminals housed in said pin-type cap to said upper side rotary pin contact terminals; and a pair of bolts fastening said pair of rotary pins of said dual connector with said pair of bulb holders, wherein said pair of bolts having a head, threaded part attached to the head and unthreaded part in the end, wherein said thread part of said pair of bolts housed in said screw fasten holes and said unthreaded part of said pair of bolt housed in said pair of rotary pin holes.

2. The light bulb with dual connector assembly according to claim 1, wherein said pair of contact terminals housed in underside of said pair of holding holes touch and contact said pair of contact terminal of said screw-thread cap when using said screw-thread cap inserted in a bulb screw socket.

3. The light bulb with dual connector assembly according to claim 1, wherein said pair of contact terminals housed in underside of said pair of holding holes touch and contact said pair of contact terminal of said pin-type cap when using said pin-type cap inserted in a bulb pin socket.

4. The light bulb with dual connector assembly according to claim 1, wherein said glass bulb for saving-energy bulbs.

5. The light bulb with dual connector assembly according to claim 1, wherein said glass bulb is an LED strip for LED bulbs.

6. A dual connector assembly attached to light bulb body providing alternative connective means for engaging different types of light bulb sockets, wherein said dual connector comprising:

a screw-thread cap having a pair of an upper side contact terminals;

a pin-type cap having two pins for fastening said pin-type cap into the light bulb socket and a pair of contact terminals from the underside surface of said pin-type cap;

a nonconductive barrier layer attached to said screw-threaded cap at one end and said pin-type cap at the opposite end;

a pair of rotary pins rotatably connecting said dual connector assembly to said light bulb body, wherein said pair of rotary pins attached to a left and right side of said nonconductive barrier layer from one side and having a rotary pin hole in the opposite side, wherein said rotary pin having an underside and upper side contact terminals;

a first pair of conductive wire connecting said pair of an upper side contact terminals of said screw-thread cap to said underside rotary pin contact terminal housed in said pair of rotary pins; and a second pair of conductive wire connecting said pair of contact terminals housed in said pin type cap to said upper side rotary pin contact terminal housed in said pair of rotary pins.

7. The dual connector assembly attached to light bulb body according to claim 4, wherein said light bulb body comprising:

a glass bulb;

a ballast housing attached to a glass bulb from one end, wherein said ballast housing having a pair of electric contact terminals housed in the left and right upper surface of said ballast housing;

a pair of sides elongated bulb holders attached to said ballast housing from the opposite end of said ballast housing, wherein said pair of bulb holders having a left and right bulb holder attached to a left and right side of the ballast housing from one end, wherein said pair of bulb holders having a pair of holding holes in the inner side and a pair of screw fasten holes in the outer surface of said pair of bulb holders from the other end of said pair of bulb holders, wherein said pair of holding holes having a pair of underside surface electric contact terminals;

a pair of conductive wire connecting said pair of electric contact terminal housed in said pair of holding holes to said pair of electric contact terminal housed in said ballast housing, wherein said pair of conductive wire extending through inside said pair of bulb holders; and a pair of bolts fastening said pair of rotary pins of said dual connector with said pair of bulb holders, wherein said pair of bolts having a head, threaded part attached to said pair of bolt head and unthreaded bolt part in the end of said pair of bolts, wherein said threaded bolt part housed in said screw fasten holes of said pair of bulb holder and said unthreaded bolt part housed in said pair of rotary pin holes.

8. A dual connector assembly attached to light bulb body according to claim 4, wherein said pair of contact terminals housed in underside of said pair of holding holes touch and contact said pair of contact terminal of said screw-thread cap when using said screw-thread cap inserted in a bulb screw socket.

9. A dual connector assembly attached to light bulb body according to claim 4, wherein said pair of contact terminals housed in underside of said pair of holding holes touch and contact said pair of contact terminal of said pin-type cap when using said pin-type cap inserted in a bulb pin socket.

10. A dual connector assembly attached to light bulb body according to claim 4, wherein said pair of rotary pin inserted into said pair of holding holes in said pair of bulb holder, wherein said pair of rotary pins rotated enabling said screw-thread cap and pin-type cap rotated to an operative position to facilitate installation of said dual connector into said bulb socket/holder.

* * * * *